US009618189B1

(12) United States Patent
Eubanks et al.

(10) Patent No.: US 9,618,189 B1
(45) Date of Patent: Apr. 11, 2017

(54) REMOVABLE COVERING SYSTEM FOR LUMINAIRE OPTIC

(71) Applicants: Jason Medric Eubanks, Golden, CO (US); Travis William Francis Boyle, Denver, CO (US); Brett Allan Guhde, Aurora, CO (US)

(72) Inventors: Jason Medric Eubanks, Golden, CO (US); Travis William Francis Boyle, Denver, CO (US); Brett Allan Guhde, Aurora, CO (US)

(73) Assignee: Cooper Technologies Company, Houston, TX (US)

( * ) Notice: Subject to any disclaimer, the term of this patent is extended or adjusted under 35 U.S.C. 154(b) by 219 days.

(21) Appl. No.: 14/634,487

(22) Filed: Feb. 27, 2015

(51) Int. Cl.

| | |
|---|---|
| ***F21V 17/10*** | (2006.01) |
| ***F21V 3/00*** | (2015.01) |
| ***F21V 17/06*** | (2006.01) |
| ***F21V 17/02*** | (2006.01) |

(52) U.S. Cl.
CPC ..... *F21V 17/105* (2013.01); *F21V 3/00* (2013.01); *F21V 17/02* (2013.01); *F21V 17/06* (2013.01)

(58) Field of Classification Search
CPC . F21V 3/00; F21V 17/02; F21V 17/06; F21V 17/105
See application file for complete search history.

(56) References Cited

U.S. PATENT DOCUMENTS

| | | | | |
|---|---|---|---|---|
| 8,764,220 | B2 * | 7/2014 | Chan | F21V 15/013 362/217.02 |
| 2010/0157604 | A1 * | 6/2010 | Quadri | F21V 9/08 362/293 |
| 2013/0343062 | A1 * | 12/2013 | Shum | F21K 9/50 362/311.02 |
| 2015/0131296 | A1 * | 5/2015 | O'Brien-Bernini | F21V 25/12 362/310 |

FOREIGN PATENT DOCUMENTS

| | | | |
|---|---|---|---|
| EP | 2689180 | A | 1/2014 |

* cited by examiner

*Primary Examiner* — Stephen F Husar
(74) *Attorney, Agent, or Firm* — King & Spalding LLP

(57) ABSTRACT

A luminaire can comprise an optic that extends lengthwise within a linear cavity of a frame of the luminaire. The optic can comprise a diffuser, such as a sheet of diffusing acrylic material, for example. The optic can have edges located at opposing ends of the linear cavity. The luminaire can comprise a cover for each of the two ends of the linear cavity. The covers can cover the edges of the optic, so that at each cavity end, there is an overlap between the optic and the cover. The overlap can provide a gap that compensates for thermal expansion and contraction of the optic relative to the frame, which may have a metal composition. One or more magnets can removably attach the cover to the frame of the luminaire.

20 Claims, 7 Drawing Sheets

REMOVABLE COVERING SYSTEM FOR LUMINAIRE OPTIC

TECHNICAL FIELD

Embodiments of the technology relate generally to lighting solutions, and more particularly to a system for covering an edge of a diffuser or other optic of a luminaire.

BACKGROUND

Luminaires typically incorporate different materials for optical and structural functions. For example, a luminaire might utilize a sheet of polymeric material for a diffuser and a metal material for a frame. Such materials typically have significantly different thermal expansion properties. For example, most polymers may expand and contract significantly more over a given temperature range than most metals. If the luminaire is made so that the different-material components fit snugly against one another at a given temperature, then when the temperature rises, some of the components may buckle due to expansion stress. And when the temperature falls, gaps that are unsightly or that leak light may open.

Accordingly, there is a need in the art for a technology that can address differing expansion properties of components in a luminaire. Need also exists for technology that can provide thermal expansion space in a luminaire. Further need exists for technology to cover thermal expansion gaps in a luminaire. Need further exists for technology to facilitate service access to internal elements of a luminaire that incorporates components having differing thermal expansion properties. A capability addressing one or more such needs, or some other related deficiency in the art, would support improved illumination and improved illumination systems.

SUMMARY

A lighting system can emit illumination from an aperture that extends lengthwise. The aperture can have an associated optic that also extends lengthwise and that processes light as the light exits the aperture. For example, the optic can comprise a diffuser that helps provide diffuse illumination. The optic can comprise an edge that is disposed adjacent an end of the aperture. The lighting system can comprise a magnetically attached cover that covers or conceals the edge of the optic. The magnetically attached cover can further cover or conceal a thermal expansion gap that provides space for the optic to shorten and lengthen with respect to a frame of the lighting system due to variation in temperature of the lighting system or the lighting system's environment.

The foregoing discussion of lighting systems is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

Figure 1A:
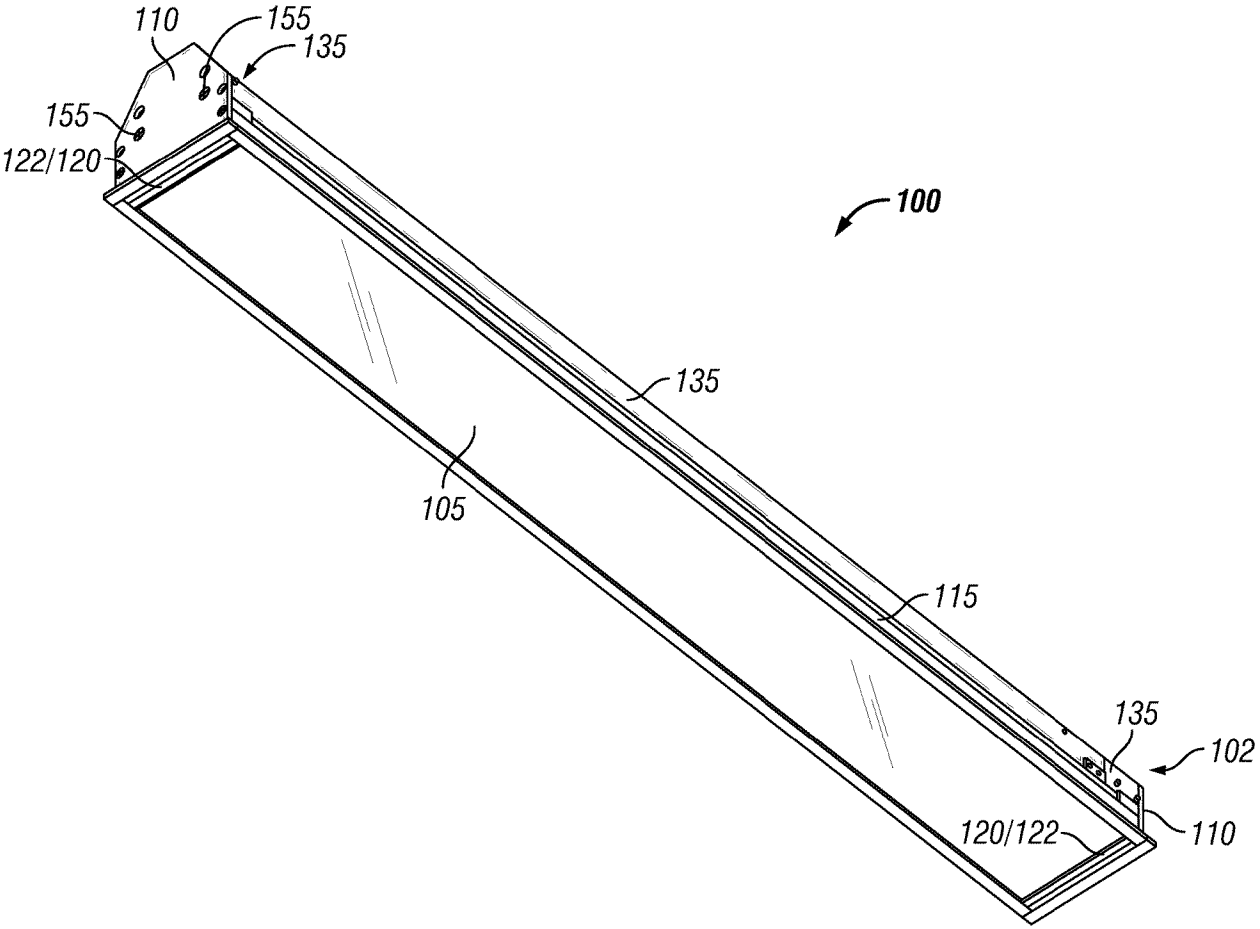
FIGS. 1A and 1B (collectively FIG. 1) respectively illustrate perspective views of lower and upper sides of a luminaire according to some example embodiments of the present disclosure.

The drawings illustrate only example embodiments and are therefore not to be considered limiting of the embodiments described, as other equally effective embodiments are within the scope and spirit of this disclosure. The elements and features shown in the drawings are not necessarily drawn to scale, emphasis instead being placed upon clearly illustrating principles of the embodiments. Additionally, certain dimensions or positionings may be exaggerated to help visually convey certain principles. In the drawings, similar reference numerals among different figures designate like or corresponding, but not necessarily identical, elements.

DESCRIPTION OF EXAMPLE EMBODIMENTS

A lighting system can comprise a magnetically attached cover that covers or conceals an edge of a diffuser or other optic. The magnetically attached cover can further cover or conceal a thermal expansion gap associated with the edge of the diffuser. The diffuser can utilize this gap to expand and contract during temperature changes, thus avoiding buckling on the one hand and light leaking from an unsightly gap on the other hand.

The present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples," "embodiments," "example embodiments," or "exemplary embodiments" given herein are intended to be non-limiting and among others supported by representations of the present technology.

Lighting systems will now be described more fully with reference to FIGS. 1-5, which describe representative embodiments of the present disclosure. FIGS. 1, 2, 3, and 4 illustrate a first embodiment of a luminaire, while FIG. 5 illustrates another embodiment of a luminaire.

Figure 1B:
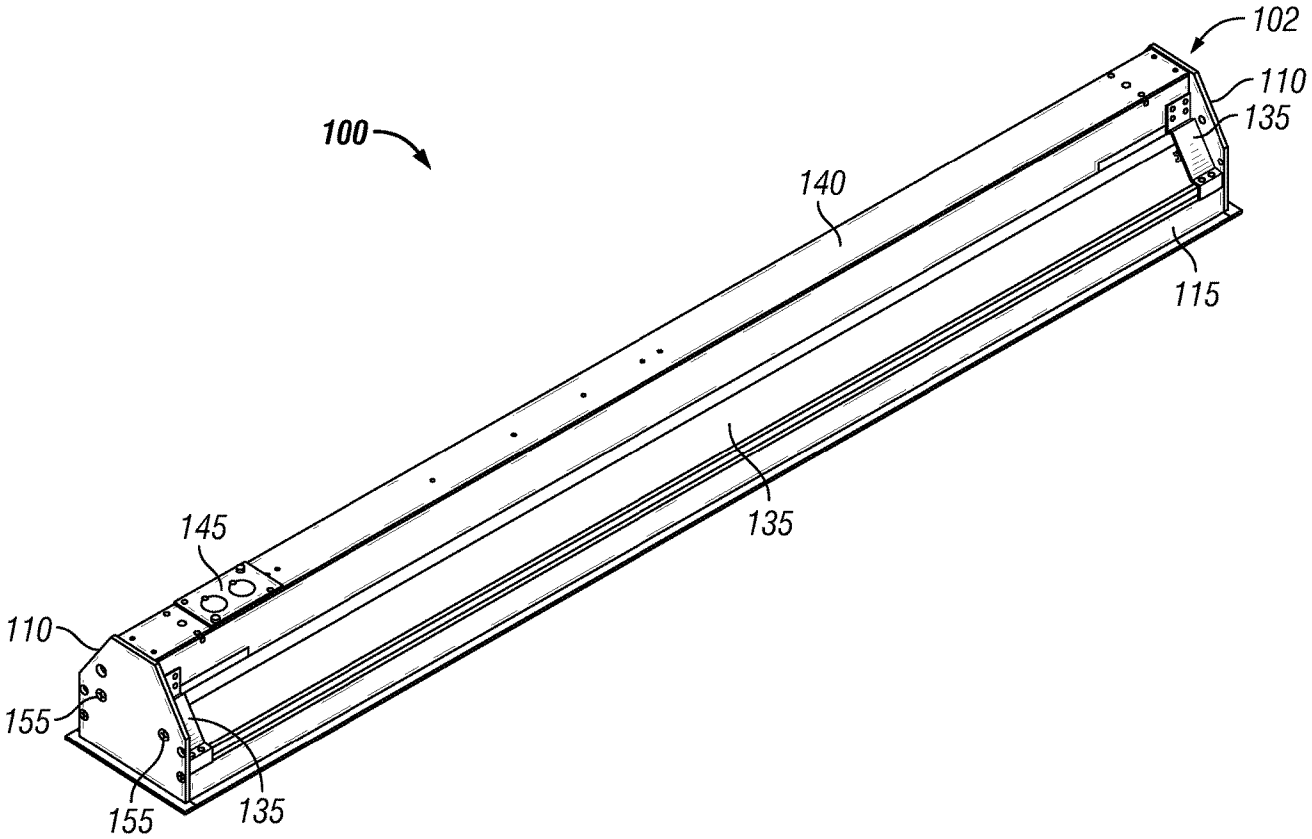
Figure 2:
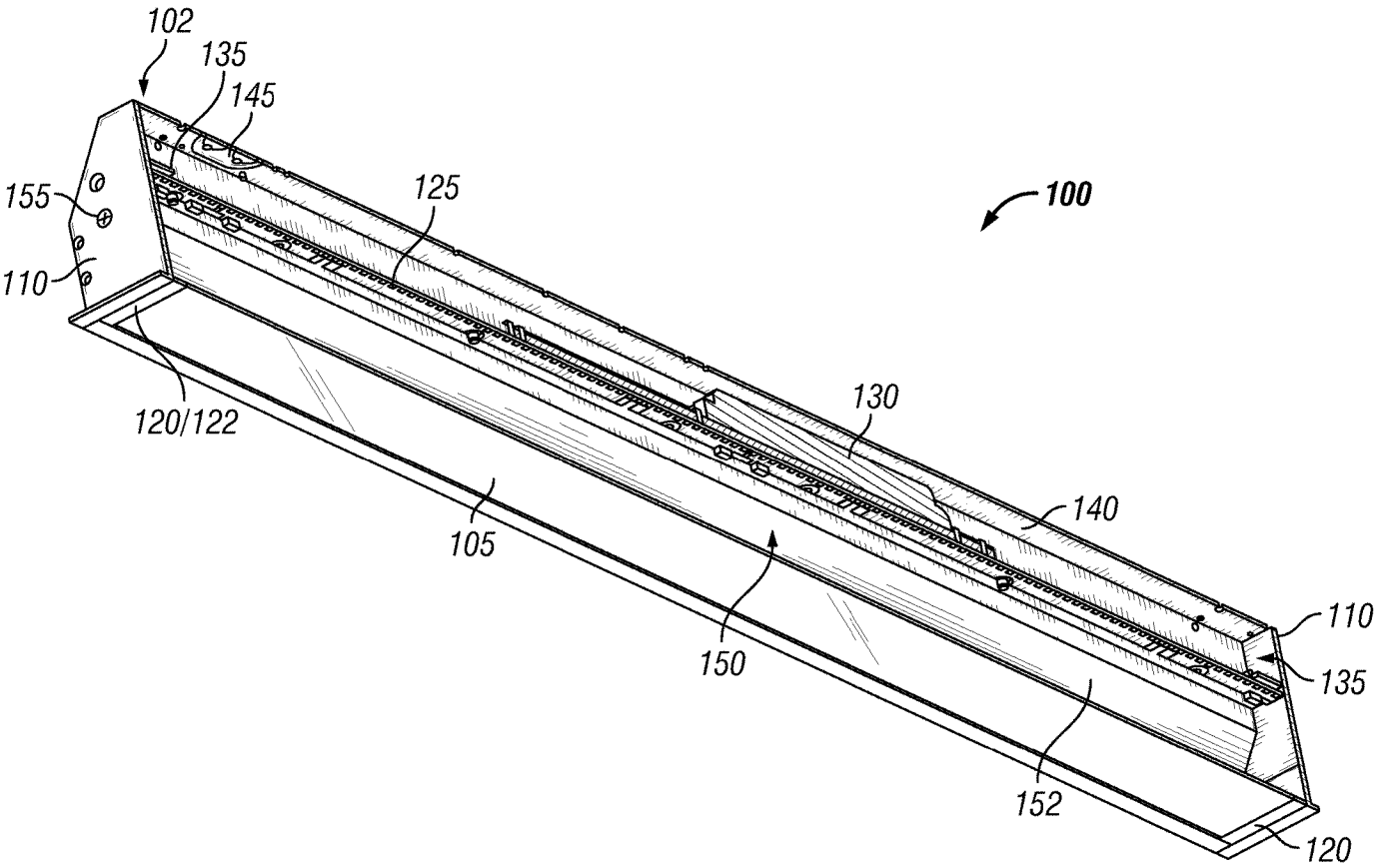
FIG. 2 illustrates a perspective view of a lengthwise cross section of the luminaire according to some example embodiments of the present disclosure.
Figure 3:
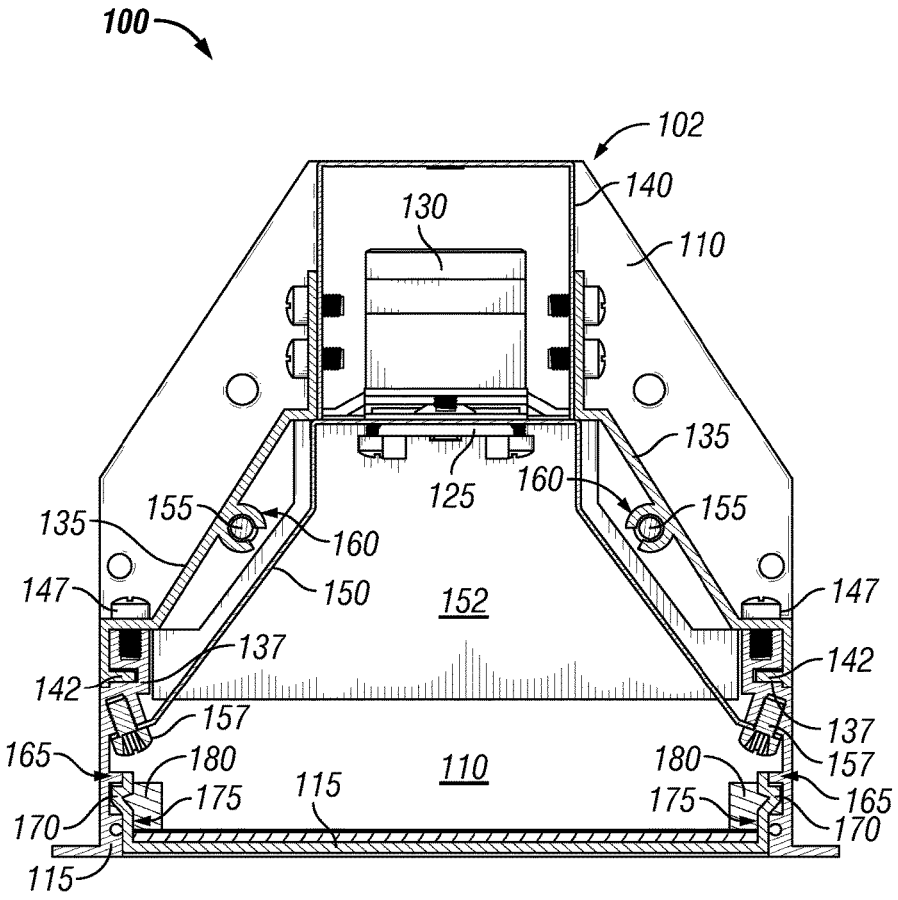
FIG. 3 illustrates a perspective view of a lateral cross section of the luminaire according to some example embodiments of the present disclosure.

Turning now to FIGS. 1, 2, 3, and 4, some example embodiments of the disclosure will be discussed. FIGS. 1A and 1B respectively illustrate perspective views of lower and upper sides of a luminaire 100. FIG. 2 illustrates a perspective view of a lengthwise cross section of the luminaire 100. FIG. 3 illustrates a perspective view of a lateral cross section of the luminaire 100, taken perpendicular to the view of FIG. 2. FIGS. 4A and 4B respectively illustrate a perspective detail view and a straight-on detail view of a lengthwise cross section of an end of the luminaire 100.

In some example embodiments, the luminaire 100 can be mounted overhead, for example recessed in a ceiling. In some example embodiments, the luminaire 100 can be mounted along an edge of a ceiling, such as recessed in the ceiling near where the ceiling adjoins a wall. Various embodiments are applicable to a wide range of indoor and outdoor applications.

In the illustrated example embodiment, the luminaire 100 is elongate, or long and narrow. In some embodiments, the luminaire 100 can have a customizable length, for example in a range of 2 feet to 12 feet. When a manufacturer receives an order for one or more of the luminaires 100, the manufacturer can produce units of a requested length utilizing standardized components that may be readily cut-to-length.

The illustrated example luminaire 100 comprises a frame 102 that provides structural support and facilitates mounting and housing of various luminaire elements. The frame 102 comprises two rails 115 that extend between two end caps 110. Luminaires 100 of arbitrary length may be fabricated by cutting segments of rail 115 to a custom length while using a universal end cap design. In some example embodiments, the rails 115 are composed of aluminum or other suitable metallic material. In some embodiments, the rails 115 are formed of acrylic or other suitable plastic/polymer material. In some embodiments, the rails 115 are formed of like material to the optic 105, which is discussed in further detail below. Accordingly, the rails 115 and the optic 105 may have similar or common optical properties, including in some embodiments a capability to diffuse light. In some embodiments, the rails 115 are formed of a composite, such as fiberglass.

The illustrated example luminaire 100 further comprises two bridges 135, one adjacent each end cap 110. The bridges 135 can be formed of a metal, such as aluminum, or of an appropriate polymer or composite material. In some embodiments, the bridges 135 may adjoin the end caps 110. In some embodiments, the bridges 135 may be adjacent the end caps 110. In some embodiments, the bridges 135 may abut or touch the end caps 110. In some embodiments, the bridges 135 may be near but separated from the end caps 110.

In some embodiments, more than two bridges 135 may be incorporated into a single luminaire. For example, a long luminaire may utilize a third bridge 135 near the luminaire center. In some luminaire embodiments, more than three bridges 135 may be incorporated, for example so they are spaced substantially equal distances from one another.

As best seen on FIG. 3, each bridge 135 comprises two snap-in channels 160 that are sized to receive fastening rods 155. The fastening rods 155 span the length of the luminaire 100 and attach to the end caps 110. The fastening rods 155 can be formed or cut to custom lengths corresponding to the custom rail lengths discussed above. The fastening rods 155 can be formed of metal, composite, fiberglass, or other appropriate materials.

In some example embodiments, the ends of the fastening rods 155 are threaded with male threads that may screw into corresponding threaded holes in the end caps 110. In some embodiments, the ends of the fastening rods 155 have male threads that fasten to corresponding nuts at the end caps 110. In some embodiments, the fastening rods 155 are threaded along their entire lengths rather than only at their ends.

In some embodiments, the ends of the fastening rods 155 are drilled and tapped with female threads. In such embodiments, the fastening rods 155 may be attached to the end caps using screws that screw into the resulting threaded holes at the ends of the fastening rods 155.

As best seen in the cross sectional view of FIG. 3, each rail 115 mates with the bridge 135 in an interlocking arrangement that enhances structural integrity. In the illustrated embodiment, the bridge 135 comprises grooves 137 that extend lengthwise. The rails 115 comprise corresponding protrusions 142 that seat in and mate with the grooves 137. Fasteners 147, which comprise screws in the illustrated embodiment, firmly attach the rails 115 to the bridges 135. Joined together as shown in FIG. 3, the rails 115, bridge 135, and other luminaire structures form a cavity 152 from which light exits into a space to be illuminated.

The illustrated example luminaire 100 further comprises a tray 150, which may be formed from a thin sheet of aluminum or polymer or other appropriate material. The tray 150 may be cut to a custom length according to a customer's specified luminaire length, for example. In the illustrated embodiment, fasteners 157, specifically screws in this embodiment, attach the tray 150 to the rails 115.

The tray 150 can be reflective so that light incident upon the tray surface is reflected out of the luminaire 100 towards a space to be illuminated. Such reflectivity can be specular in some embodiments or diffuse reflectivity in others. The diffuse reflectivity can be due to a metallic surface pattern or a diffusely reflective paint or other appropriate coating. The tray 150 can line at least a portion of the cavity 152, for example.

In the illustrated example embodiment, the upper side of the luminaire 100 comprises a hood 140 that forms an enclosure to house electrical elements of the luminaire 100. The hood 140 extends between and attaches to the bridges 135, so that the resulting electrical enclosure extends longitudinally along the luminaire 100 above the cavity 152.

As best seen in FIGS. 1B and 2, the example hood 140 comprises a wiring port 145 through which electrical supply lines pass to feed electricity to the luminaire 100. As illustrated, the wiring port 145 comprises a plate that is mounted to the hood 140. In some other embodiments, the wiring port 145 can be formed directly in the hood 140 or in some other suitable part of the luminaire 100.

As visible in the cross sectional views of FIGS. 2 and 3, the hood 140 encloses a light emitting diode (LED) driver 130. The example hood 140 further encloses supporting electrical elements. Such electrical elements may include wiring that couples to an electrical supply line, which an installer can pass through the wiring port 145 during installation of the luminaire 100.

The light emitting diode driver 130 supplies electricity to a row of light emitting diodes 125 that extends lengthwise within a ceiling of the cavity 152 as illustrated in FIGS. 2 and 3. In some embodiments, the light emitting diodes 125 comprise modules that may comprise banks of light emitting diodes 125, for example. Using modular light emitting diodes 125 can facilitate fabrication of luminaires 100 that are build-to-order according to customer length preference. For example, if a customer places an order for a luminaire of a custom length, an appropriate number of light emitting diode modules can be readily mounted during fabrication to meet the customer's specific needs.

In operation, the light emitting diodes 125 emit light into the cavity 152. The light exits the cavity 152 through the optic 105, positioned at the cavity aperture, to provide illumination for an area, such a room or hallway for example. In the illustrated embodiment, the optic 105 can comprise a diffuser that softens and diffuses the illumination. The optic 105 can comprise a sheet of acrylic or other suitable optical material, for example. In some embodiments, the surface of the optic 105 can be patterned with features that diffuse transmitting light via refraction, for example microlenses or relief structures. In some embodiments, the optic 105 is loaded with scattering material that diffuses light as the light transmits through the optic 105. The scattering material may be homogenously distributed within the optic 105 or preferentially oriented to an inner or outer side of the optic 105, for example. The optic 105 can be translucent, colored, or clear in various example embodiments.

Figure 4A:
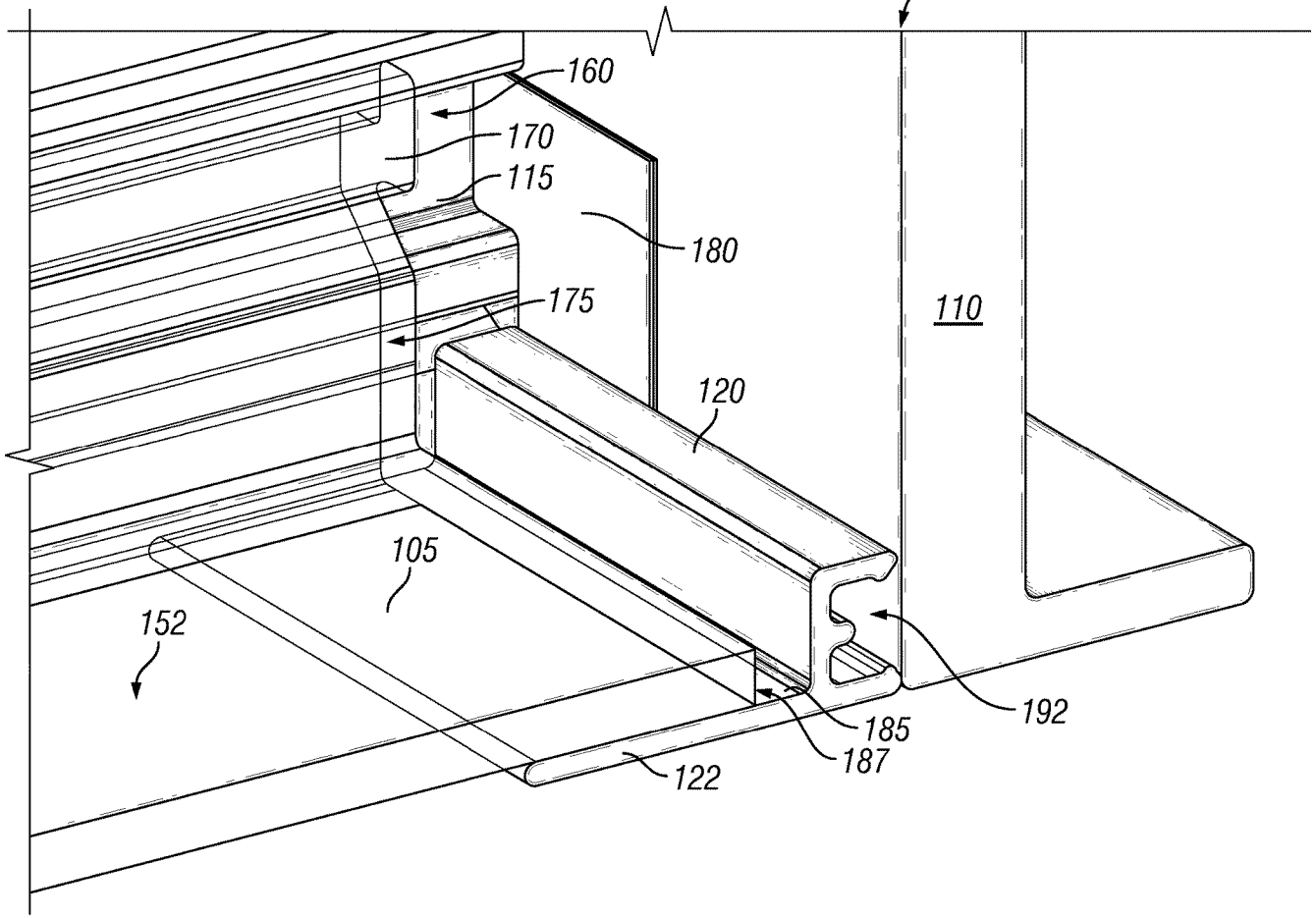
FIGS. 4A and 4B (collectively FIG. 4) respectively illustrate a perspective detail view and a straight-on detail view of a lengthwise cross section of an end of the luminaire according to some example embodiments of the present disclosure.
Figure 5B:
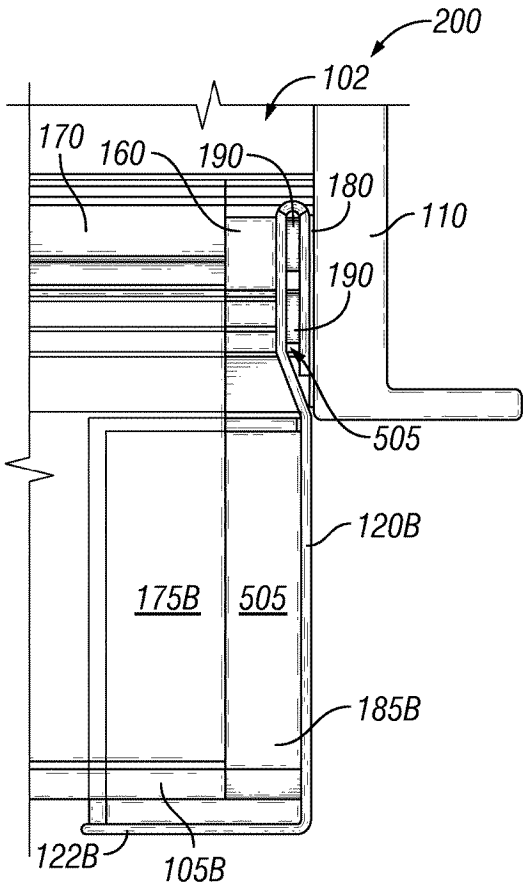
FIGS. 5A and 5B (collectively FIG. 5) respectively illustrate a perspective detail view and a straight-on detail view of a lengthwise cross section of an end of another luminaire according to some example embodiments of the present disclosure.

As shown in FIGS. 3 and 4A, the example optic 115 is formed to provide a flat lower surface through which light passes and two sides 175 that are bent up, to provide a cross section having a U-shaped geometry. Each side 175 of the optic 105 comprises a protrusion 170 that extends lengthwise between opposing ends of the luminaire 100. The protrusions 170 seat in grooves 165 of the rails 115 that face inward, towards the cavity 152. In an example embodiment, the protrusions 170 of the optic 105 can readily snap into and out of the grooves 165. Accordingly, personnel can readily take the optic 105 on and off of the luminaire 100 in connection with accessing and closing the cavity 152 for service, installation, or other appropriate activity. The protrusion-and-groove arrangement further allows the optic 105 and the frame 102 to lengthen and shorten without undue stress as temperature changes. That is, the rails 115 and the optic 105 can expand and contract lengthwise without binding. The arrangement thus facilitates thermal expansion and contraction of the various luminaire elements.

Figure 4B:
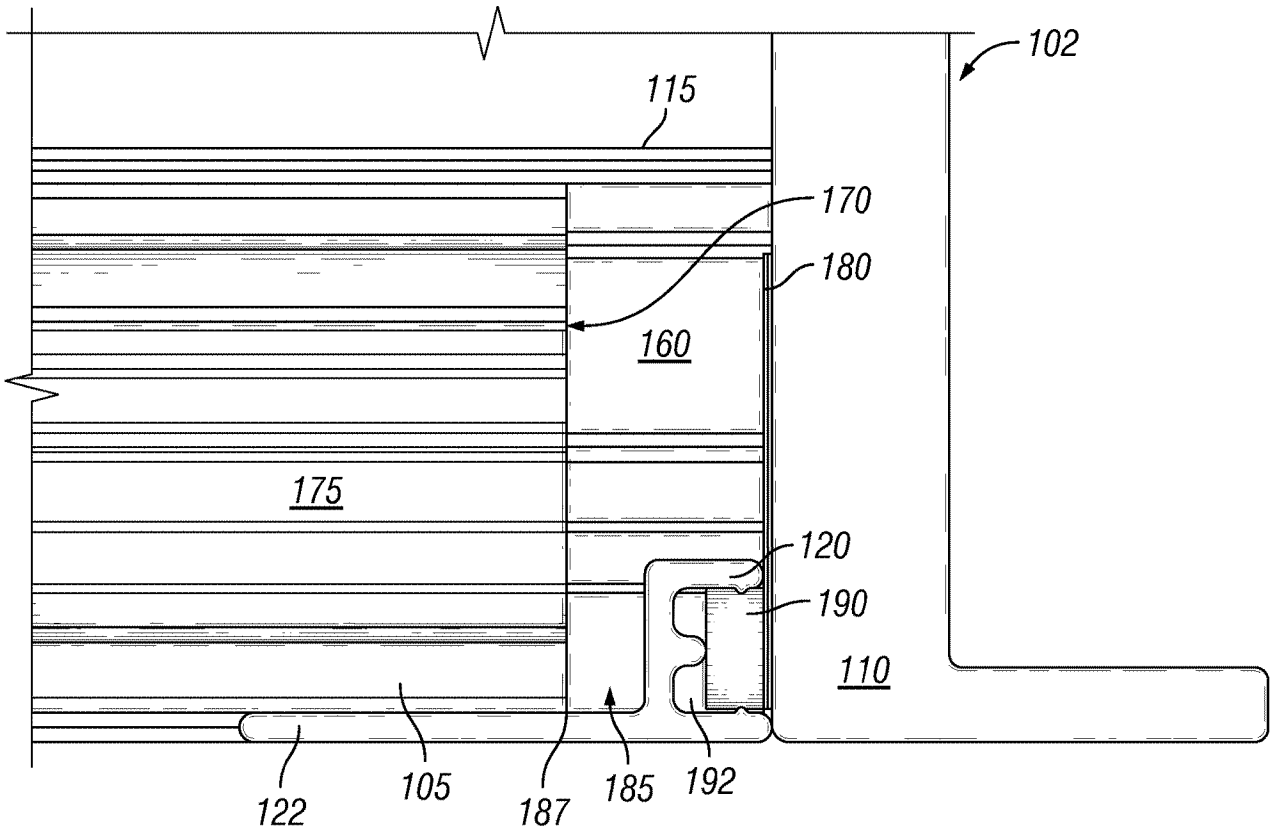

As visible in FIGS. 4A and 4B, the optic 105 comprises two edges 187 located at opposing ends of the luminaire 100. An expansion gap 185 separates the edge 187 from the end cap 110 and provides space for the optic 105 to expand and contract relative to the frame 102 of the luminaire 100 over temperature fluctuations, as discussed above.

A removable cover 120 comprises a lip 122 that is situated below the edge 187 of the optic 105. Thus, the lip 122 overlaps and covers the edge 187 of the optic 105. In some example embodiments, the removable cover 120 is opaque and serves to block light from exiting the luminaire 100 through the expansion gap 185. The removable cover 120 may further obscure the edge 187 of the optic 105 from view by an observer. The removable cover 120 may further provide personnel with ready access to the edge 187 of the optic 105. For example, a person seeking to service the luminaire 100 may remove the removable cover 120 and then grasp the edge 187 to facilitate removal of the optic 105 as discussed above.

In some embodiments, the removable cover 120 is made of acrylic or other material through which light can pass. In some embodiments, the removable cover 120 is formed of the same material as the optic 105. Thus, the removable cover 120 may exhibit like optical properties and function to the optic 105, discussed above.

In the illustrated example embodiment, the removable cover 120 magnetically attaches to the frame 102 of the luminaire 100. More specifically, the removable cover 120 attaches to the end cap 110 of the luminaire 100 via a magnet 190 and a ferrous tape 180. The ferrous tape 180 provides the end cap with a magnetically active material so that the magnet 190 can hold to the end cap 110 using magnetic force even if the end cap 110 is otherwise made of acrylic, aluminum, or other material that is not magnetically inactive. In various example embodiments, the ferrous tape 180 can be attached to the end cap 110 using screws, rivets, fasteners, glues, adhesives, solder, or some other appropriate fastening technology.

In some embodiments, a thick rigid member made of iron or other magnetically active material is incorporated for the function of the ferrous tape 180. In some example embodiments, at least a portion of the end cap 110 is inset with or otherwise comprises a section of iron or other magnetically active material.

As illustrated in FIG. 4B, the magnet 190 is retained in a channel 192 of the removable cover 120. In some embodiments, the magnet 190 is press fit into the channel 192 for retention. In various embodiments, the magnet 190 can be glued, bonded, riveted, screwed, or otherwise fastened to the removable cover 120. In one example embodiment, the magnet 190 is made of the material known in the trade under the specification "N42SH," which is commercially available from multiple sources.

In some embodiments, a magnet is attached to the end cap 110 of the luminaire 100 or to some other portion of the frame 102, and the ferrous tape 180 is attached to the removable cover 120. In some embodiments, one magnet is attached to the end cap 110, another magnet is attached to the removable cover 120, and the two magnets are oriented to attract one, but can still be readily separated for luminaire service.

Figure 5A:
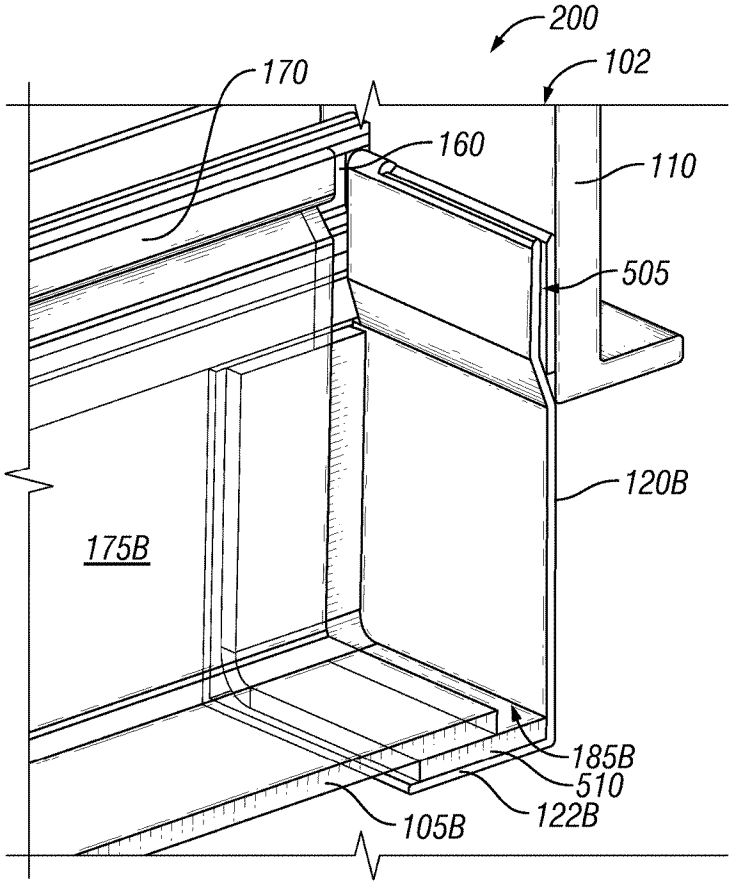

Turning now to FIG. 5, this figure illustrates two views of another example luminaire embodiment. FIG. 5A illustrates a perspective detail view of a lengthwise cross section of an end of the luminaire 200, while FIG. 4B illustrates a perspective straight-on detail view of the lengthwise cross section of the end of the luminaire 200.

The luminaire 200 of FIG. 5 utilizes the same base configuration and frame components as the luminaire 100 illustrated in FIGS. 1, 2, 3, and 4 as discussed above, but with different example embodiments of the optic 105B and the removable cover 120B. The optic 105B and removable cover 120B of the luminaire 200 illustrated in FIG. 5 extend further below the frame 102, as may be desirable for some applications or to meet some customer preferences.

In the illustrated embodiment of FIG. 5, the upper section of the removable cover 120B is folded over and the two magnets 190 are inserted and retained in the resulting slot 505. The two magnets 190 magnetically engage with a ferrous tape 180, which is attached to the end cap 100 of the luminaire 200 as discussed above.

The removable cover 120B comprises a spacer 510 that is disposed between the optic 105B and the cover lip 122B. The spacer 510 extends up the side 175B of the optic 105B for enhanced stability. In some embodiments, the spacer 510 is bonded or otherwise fastened or attached to the cover 120. In some other embodiments, the spacer 510 may have at least some degree of freedom of movement along the elongate luminaire dimension.

Illumination technology has been described. From the description, it will be appreciated that embodiments of the present technology overcome limitations of the prior art. Those skilled in the art will appreciate that the present technology is not limited to any specifically discussed application or implementation and that the embodiments described herein are illustrative and not restrictive. From the description of the example embodiments, equivalents of the elements shown therein will suggest themselves to those skilled in the art, and ways of constructing other embodiments of the present technology will appear to practitioners of the art.

What is claimed is:

1. A lighting fixture comprising:

a frame comprising a cavity, the cavity comprising:

an upper portion;

a lower portion; and an aperture disposed at the lower portion;

a light source disposed in the upper portion of the cavity;

an optic disposed adjacent the aperture, the optic comprising an edge; and a cover magnetically attached to the frame, the cover comprising a lip disposed adjacent the aperture, the lip disposed below the edge of the optic.

2. The lighting fixture of claim 1, wherein the light source comprises a plurality of light emitting diodes.

3. The lighting fixture of claim 1, wherein the optic comprise a diffuser.

4. The lighting fixture of claim 1, wherein the cover is magnetically attached to an end cap of the lighting fixture.

5. The lighting fixture of claim 1, further comprising an expansion gap disposed adjacent the lip, between the edge of the optic and the frame.

6. The lighting fixture of claim 1, wherein the cover comprises a magnet, wherein the frame comprises a ferrous tape attached to a nonmagnetic material.

7. A luminaire comprising:

a frame that extends lengthwise between a first end and a second end;

a diffuser that extends lengthwise and that comprises a first edge disposed adjacent the first end of the frame and a second edge disposed adjacent the second end of the frame; and a member that magnetically attaches to the first end of the frame to cover the first edge of the diffuser adjacent the first end of the frame.

8. The luminaire of claim 7, further comprising:

a second member that magnetically attaches to the second end of the frame to cover the second edge of the diffuser adjacent the second end of the frame; and a row of light emitting diodes extending lengthwise above the diffuser.

9. The luminaire of claim 7, wherein the luminaire comprises an overhead luminaire, wherein the member comprises a cover, and wherein the luminaire comprises a magnet and a ferrous tape that magnetically attach the cover and the first end of the frame to one another.

10. The luminaire of claim 7, wherein the diffuser comprise acrylic, wherein the frame comprises aluminum, and wherein the luminaire further comprises a thermal expansion gap disposed at the first end of the frame, between the first edge of the diffuser and the frame, wherein the thermal expansion gap compensates for differences in lengthwise expansion and contraction between the aluminum of the frame and the acrylic of the diffuser.

11. The luminaire of claim 7, wherein the member comprises a cover, wherein the cover comprises a lip, wherein the lip of the cover is disposed under the first edge of the diffuser, and wherein the cover and the diffuser comprise acrylic material.

12. An overhead luminaire comprising:

a frame that comprises:

a first end cap;

a second end cap; and an elongate cavity extending longitudinally between the first end cap and the second end cap;

a plurality of light emitting diodes disposed along an upper side of the elongate cavity;

an elongate optic disposed along a lower side of the elongate cavity, the elongate optic comprising:

a first edge disposed adjacent the first end cap; and a second edge disposed adjacent the second end cap;

a cover comprising a lip that is disposed under the first edge of the elongate optic; and at least one magnet that attaches the cover to the first end cap.

13. The overhead luminaire of claim 12, wherein the at least one magnet is press fit into a channel of the cover.

14. The overhead luminaire of claim 13, wherein the frame comprises:

a nonferrous material; and a ferrous tape attached to the nonferrous material, the ferrous tape adjoining the at least one magnet.

15. The overhead luminaire of claim 14, wherein the nonferrous material comprises nonferrous metal, wherein the elongate optic comprises a diffuser having a polymeric composition, and wherein the lip is sized to compensate for differences in thermal expansion between the polymeric composition and the nonferrous metal.

16. The overhead luminaire of claim 12, further comprising a thermal expansion gap that is disposed between the first edge of the elongate optic and the first end cap and that is disposed above the lip, and wherein the thermal expansion gap compensates for differences in lengthwise expansion and contraction between the elongate optic and the frame.

17. The overhead luminaire of claim 12, wherein the frame further comprises an electrical housing disposed above the cavity, wherein the overhead luminaire further comprises at least one light emitting diode driver that is disposed in the electrical housing and that is electrically connected to the plurality of light emitting diodes, and wherein an upper side of the electrical housing comprises a port sized for coupling an electrical supply line to the at least one light emitting diode driver.

18. The overhead luminaire of claim 12, wherein the cover comprises acrylic material.

19. The overhead luminaire of claim 12, wherein the frame comprises a pair of rails extending longitudinally on opposing sides of the elongate cavity.

20. The overhead luminaire of claim 12, wherein the frame comprises a first rail and a second rail that extend longitudinally adjacent the elongate cavity, wherein the first rail comprises a first groove that extends longitudinally and that faces the elongate cavity, wherein the second rail comprises a second groove that extends longitudinally and that faces the elongate cavity, wherein the elongate optic comprises a first protrusion and a second protrusion, each extending longitudinally, wherein the first protrusion is seated in the first groove, and wherein the second protrusion is seated in the second groove.

* * * * *